US010254089B2

(12) United States Patent
Gosson et al.

(10) Patent No.: US 10,254,089 B2
(45) Date of Patent: Apr. 9, 2019

(54) FIREARM-MOUNTED DEFENSE SPRAY FOREGRIP SYSTEM

(71) Applicant: Ohio Valley Defense, LLC, Cincinnati, OH (US)

(72) Inventors: Mark Gosson, Cincinnati, OH (US); Curtis Miller, Delray Beach, FL (US); Andrew Newman, Fort Myers, FL (US); Bradley Ruff, Cincinnati, OH (US)

(73) Assignee: Ohio Valley Defense, LLC, Cincinnati, OH (US)

( * ) Notice: Subject to any disclaimer, the term of this patent is extended or adjusted under 35 U.S.C. 154(b) by 0 days.

(21) Appl. No.: 15/138,087

(22) Filed: Apr. 25, 2016

(65) Prior Publication Data

US 2016/0313095 A1 Oct. 27, 2016

Related U.S. Application Data

(60) Provisional application No. 62/152,021, filed on Apr. 23, 2015.

(51) Int. Cl.

| | |
|---|---|
| ***F41H 9/10*** | (2006.01) |
| ***F41C 23/16*** | (2006.01) |
| ***F41B 9/00*** | (2006.01) |

(52) U.S. Cl.

CPC ..... *F41H 9/10* (2013.01); *F41B 9/0071* (2013.01); *F41B 9/0087* (2013.01); *F41C 23/16* (2013.01)

(58) Field of Classification Search

CPC ..... F41H 9/10; F41C 23/16; F41B 9/0071; F41B 9/0087

USPC ..... 42/1.08; 89/1.2

See application file for complete search history.

(56) References Cited

U.S. PATENT DOCUMENTS

| | | | | |
|---|---|---|---|---|
| 1,567,659 | A * | 12/1925 | Lawrence | F41H 9/10 102/370 |
| 3,730,390 | A | 4/1973 | Adrian et al. | |
| 3,841,526 | A | 10/1974 | Haskins | |
| 4,186,851 | A | 2/1980 | Cantor | |
| 5,397,029 | A * | 3/1995 | West | B65D 83/202 222/153.01 |
| 5,671,559 | A | 9/1997 | Ludaescher et al. | |
| 5,673,819 | A * | 10/1997 | Brunswig | F21V 33/0064 222/113 |

(Continued)

*Primary Examiner* — Stephen Johnson
*Assistant Examiner* — Benjamin S Gomberg

(57) ABSTRACT

The disclosure is premised on the realization that despite the apparent convenience, safety and effectiveness possible by use of a less-lethal weapon incorporated into the foregrip of a two-handed weapon, no major police department, government agency, or military unit deploys such a system. This deficiency can be remedied by the disclosed device, which comprises a less-lethal weapon system that employs industry-standard components, and is effective and easy to use. The disclosed invention mounts a standard-size incapacitant canister in the handgrip portion of a foregrip. The foregrip is secured to the firearm by a standard rail system, and uses standard trigger and safety configurations. The canister magazine allows for efficient loading and reloading of the incapacitant, and the canister mounting angle allows for effective use. Further, some embodiments of the invention may include an accessory mounting area in which a tactical flashlight or laser may be mounted.

13 Claims, 13 Drawing Sheets

(56) References Cited

U.S. PATENT DOCUMENTS

| | | | | |
|---|---|---|---|---|
| 5,787,628 | A | 4/1998 | Teetzel | |
| 5,983,548 | A | 11/1999 | Ludaescher | |
| 6,196,149 | B1 | 3/2001 | Haney et al. | |
| 6,196,419 | B1 * | 3/2001 | Haney | B65D 83/202 222/153.03 |
| 6,546,661 | B1 | 4/2003 | Staubs | |
| 6,658,779 | B2 * | 12/2003 | Bauer | B65D 83/202 222/79 |
| 7,644,839 | B2 | 1/2010 | McNulty | |
| 8,510,979 | B1 | 8/2013 | Mortimer | |
| 8,985,397 | B2 * | 3/2015 | Lord | G08B 21/02 222/1 |
| 9,423,208 | B1 * | 8/2016 | Mahmalji | F41C 23/16 |
| 2006/0120009 | A1 * | 6/2006 | Chudy, II | F41H 13/0025 361/232 |
| 2007/0086190 | A1 | 4/2007 | Kukuk | |
| 2007/0163245 | A1 * | 7/2007 | Sheridan | F01N 3/2066 60/286 |
| 2012/0118990 | A1 * | 5/2012 | Beever, III | F41B 9/0025 239/1 |
| 2014/0263445 | A1 | 9/2014 | Rowlett et al. | |
| 2015/0121737 | A1 * | 5/2015 | Anderson | F41C 23/16 42/72 |
| 2016/0313095 | A1 * | 10/2016 | Gosson | F41H 9/10 |

* cited by examiner

FIREARM-MOUNTED DEFENSE SPRAY FOREGRIP SYSTEM

STATEMENT REGARDING FEDERALLY SPONSORED RESEARCH OR DEVELOPMENT

No federal funds were utilized for this invention.

CROSS-REFERENCE TO RELATED APPLICATIONS

The present application relates to U.S. Provisional Application No. 62/152,021, filed Apr. 23, 2015, the disclosure of which is hereby incorporated herein by reference in its entirety.

BACKGROUND OF THE INVENTION

Less-lethal weapons such as pepper-spray and other incapacitants are an essential part of the military and law enforcement arsenal. Using an incapacitant, however, is inconvenient and dangerous when an operator is carrying a two-handed firearm. In these situations, the operator is forced to choose between lethal and less-lethal weapons options, potentially endangering the operator's life or that of an individual confronting him or her. One solution for this problem is to mount an incapacitant dispenser on the firearm. To date, however, designs for doing so have been inadequate, and no such less-lethal weapon system has achieved significant adoption by any national law enforcement body.

Previous designs known in the art have either employed non-standard mechanisms that require additional training for use, have proven difficult to use, use a longitudinal mounting design, are not reloadable during use, or simply are not enabled. (See, e.g., U.S. Pat. No. 6,546,661 (disclosing a longitudinally-mounted canister); U.S. Pat. No. 6,658,779 (disclosing a incapacitant canister mount in a broader weapon disclosure, but failing to enable canister exchange); U.S. Pat. No. 5,787,628 (disclosing a less-lethal weapon mount that does not utilize a standard incapacitant canister).

The invention disclosed herein overcomes these drawbacks by disclosing a less-lethal weapon system that incorporates an incapacitant canister into a foregrip mountable to a two-handed firearm. The foregrip allows operators to hold and aim the firearm more quickly and more comfortably. However, the typical foregrip usually serves few other practical purposes, often simply being a hollow cavity where additional batteries or other tactical items might be stored. The disclosed invention allows the foregrip to serve its original purpose of improving control, but also equips the firearm with a less-lethal weapon system. The disclosed invention features industry-standard and otherwise compatible components for easy integration into major firearms and personnel training systems, including a standard mounting rail and trigger mechanism. This allows deployment of the invention with minimal personnel retraining, and permits operators to rely on muscle memory gained through years of fieldwork. The invention also features the use of a standard-sized incapacitant canister that can be mounted in a canister magazine for quick and efficient loading and replacement. The foregrip is configured to provide a comfortable tactical feel and an optimal canister mounting angle for effective deployment of the less-lethal medium. Further, the invention is designed to work with various incapacitant media, including sprays, gels and foams.

Before continuing with the background, a variety of definitions should be made, these definitions gaining further appreciation and scope in the detailed description and embodiments of the disclosed device. All terms defined herein are to be construed broadly, in accordance with their ordinary and customary meaning to a person having ordinary skill in the art.

"Foregrip" means a handgrip mounted in a position forward of the main handgrip and trigger mechanism of a firearm that is used by the non-dominant hand to steady the firearm during operation.

"Incapacitant" means a spray, gel or foam medium containing capsaicin, pelargonic acid vanillylamide (PAVA), 2-chlorobenzalmalononitrile (CS Gas), or other chemical capable of causing temporary physiological or mental effects, which render an individual incapable of concerted action.

"Standard canister" means an incapacitant container typically having a diameter of 1.5 inches and a height of 4 inches. However, in some embodiments the invention may be configured to work with other sized canisters.

This has served as a background for the disclosure, including underlying technical innovation needed to fully appreciate the disclosed device, which will now be summarized.

SUMMARY OF THE INVENTION

The disclosed invention is premised on the realization that despite the apparent convenience, safety and effectiveness that could be possible by use of a less-lethal weapon incorporated into the foregrip of a two-handed weapon, no major police department, government agency, or military unit deploys such a system. This deficiency can be remedied by use of the disclosed device, which discloses a less-lethal weapon system that employs industry-standard components, and is effective and easy to use. The disclosed invention mounts a standard-size incapacitant canister in the handgrip portion of a foregrip. The foregrip is secured to the firearm by use of a standard rail system, and uses standard trigger and safety configurations. The canister magazine allows for efficient loading and reloading of the incapacitant, and the mounting angle of the canister allows for effective use. Further, some embodiments of the invention may include an accessory mounting area in which a tactical flashlight or laser may be mounted.

BRIEF DESCRIPTION OF THE DRAWINGS

The objects and advantages of the disclosed invention will be further appreciated in light of the following detailed descriptions and drawings in which.

DETAILED DESCRIPTION OF THE INVENTION

The detailed description of the disclosed device will be primarily, but not entirely limited to subcomponents, subsystems, and sub methods, of less-lethal weapons systems, including incapacitant media. Therefore, although not described in detail here, other essential features which are readily interpreted from or incorporated along with the disclosed invention shall be included as part of the device. The specification for the device provides specific examples to portray inventive steps, but which will not necessarily cover all possible embodiments commonly known to those skilled in the art. For example, the specific invention disclosed will not necessarily include all obvious features needed for operation, examples being materials specifications, metal/alloy composition and metal treatment parameters, sealing components, connecting hardware, and surface coatings, among other things.

The disclosed invention applies to any type of less-lethal weapon device that may be mounted to a firearm designed for two-handed use, and serve as the firearm's foregrip. In some embodiments of the disclosed invention, the device will require battery power. The disclosed device may benefit from metals, alloys, chemicals, materials, electronics, and other features or designs, as commonly known to those skilled in the art of incapacitants, less-lethal and lethal weapons manufacture, and product design. The disclosed invention applies to any type of device that dispenses an incapacitant in liquid, gel, foam, dry powder, or other media. The disclosure includes all direct or indirect mechanisms of actuating the incapacitant canister mechanism. The invention may include all known variations of standard-size incapacitant canisters. It is understood that many embodiments may require additional supporting technology or features, which are not captured in the description herein. Many of these auxiliary features of the device may, or may not, also require aspects of the disclosure.

Figure 1:
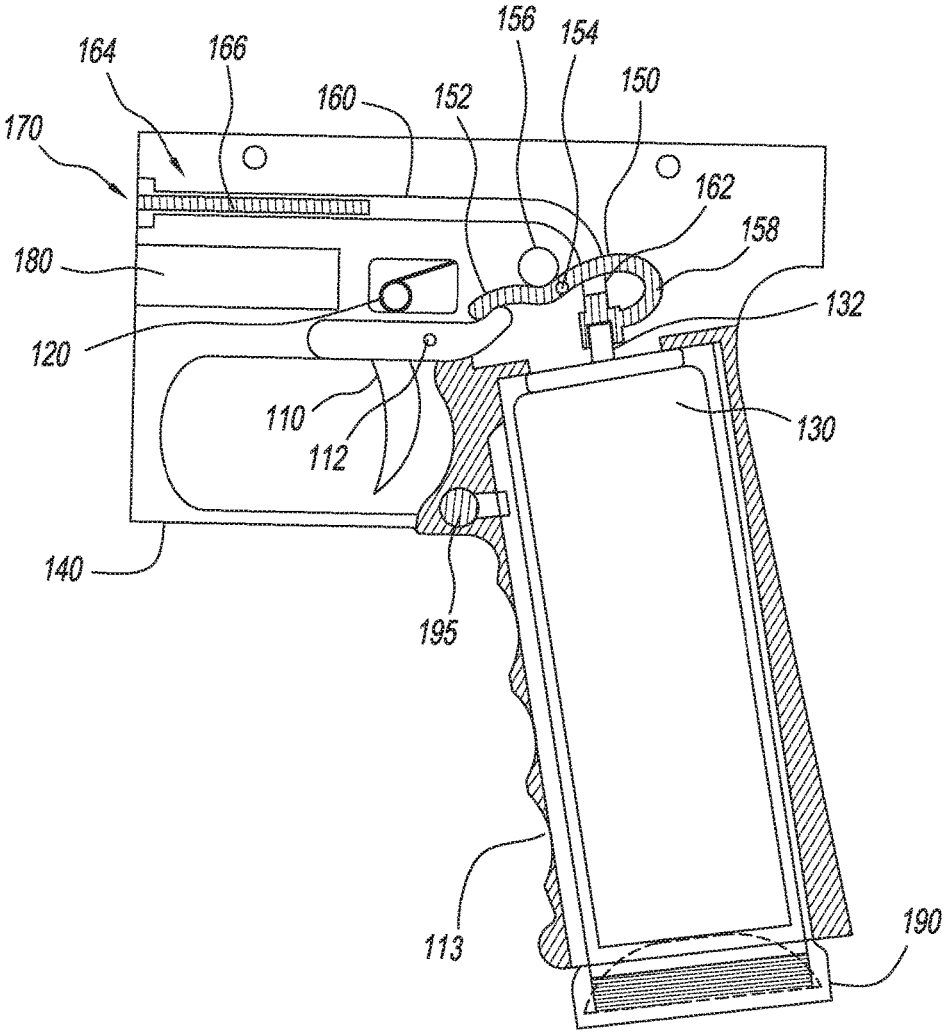
FIG. 1 is an example embodiment of at least a portion of the device of the disclosed invention featuring a side profile cutaway view of the device.

With reference to FIG. 1, the disclosed invention primarily must function as an effective foregrip. Comfort and familiarity of feel in the operator's hand are therefore primary considerations of the design. In some embodiments, therefore, the handgrip may feature scoring in various patterns (see FIG. 2, 213), it may include grips 113 for finger placement, it may have a thumb rest, crotch, palm rest, or other grip features available to support the operator's preference.

With further reference to FIG. 1, the disclosed invention includes a trigger mechanism 110. The trigger is configured to provide an industry-standard trigger pull path and industry-standard or custom pull weight. To provide the standard pull path, the trigger pivots from a fixed axis 112 located behind the trigger face. Pull weight of, e.g., approximately 5 pounds, is supplied by a spring 120 seated above the trigger, acting in conjunction with the resistance supplied by the actuator assembly 132 of a typical incapacitant canister 130. The spring 120 applies downward force to the trigger 110, which becomes resistance to the trigger's rearward movement, and augments the canister actuator resistance. The trigger pull weight also serves as a safety means to reduce the occurrence of negligent discharges when the safety selector is not engaged. Some embodiments may omit the spring 120 altogether (not shown) and operate solely through resistance from the actuator assembly. The disclosed device also includes a finger guard 140 of industry-standard configuration. Some embodiments may feature a guard with an opening sufficient to allow gloved operation. The finger guard 140 also serves as an additional safety means to protect the trigger from accidental actuation.

Figure 6:
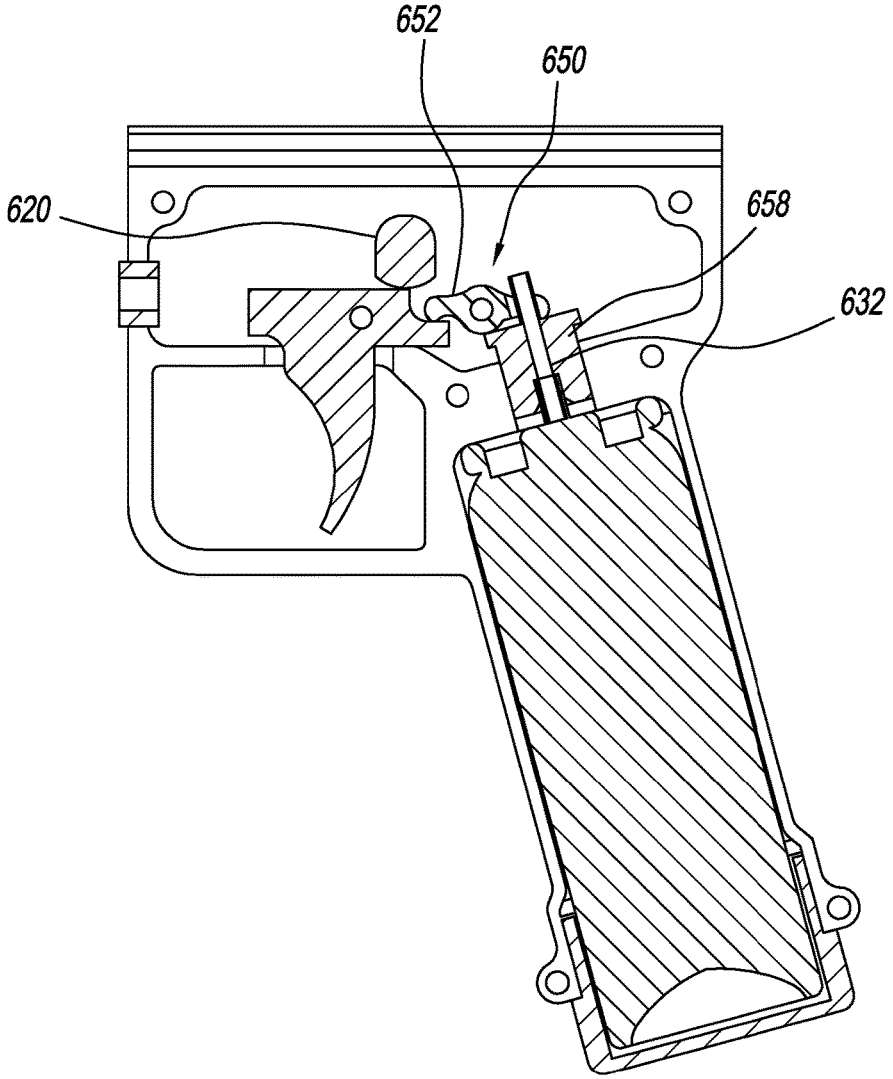
FIG. 6, is an example embodiment of at least a portion of a device of the disclosed invention including a safety selector mechanism with an alternate internal configuration.

With further reference to FIG. 1, the disclosed invention includes an actuator mechanism 150. The actuator is positioned so that a first end 152 is in contact with the trigger mechanism. The actuator also has a pivot point 154, with the portion of the actuator forward of the pivot point in selective contact with a safety selector 156. The actuator also has a second end 158 that is configured to hold an incapacitant canister's triggering mechanism 132 when the canister and magazine are inserted into the device. For example, many canisters feature a short section of tubing that is connected perpendicularly to the canister. When the tubing is displaced, gas and the incapacitant are released out of the canister through the tubing. Accordingly, the second end 158 of the actuator would include a cup-like section that fits over the canister tubing. With reference to FIG. 6, in some embodiments, the actuator 650 may be configured in two pieces corresponding to the first end 652 and the second end 658. With further reference to FIG. 1, the actuator 150 both acts on the canister tubing 132 to dispense the incapacitant, and has an opening that allows the incapacitant to pass from the canister into the tubing 160 for discharge. When an operator pulls the trigger 110 rearward, the first end 152 of the actuator is pushed up, which causes the actuator to turn about its pivot point, moving the second end 158 of the actuator so that it displaces the canister tubing 132 from the perpendicular and releases the incapacitant. Behind the pivot point, the actuator also includes an opening to allow the tubing, and thus the incapacitant, to pass through the actuator by the most direct path.

With further reference to FIG. 1, the disclosed invention also includes a section of tubing 160 to transport the incapacitant from the canister to the front of the device. The tubing has a first end 162 that connects with the actuator (and in turn the canister tubing), and a second end 164 that connects with a nozzle 170. The tubing is routed through the device to minimize its length and is held in place by snap clamps, or similar means, that are placed at intervals along the path of the tubing. The travel path of the tubing within the device may differ for different embodiments, provided that the travel path incorporates only smooth bends or curves. The tubing may be configured to have the same or larger inner diameter than the canister outlet. Inside the second end of flexible tubing is a section of laminar pipe 166. The laminar pipe aligns the flow of incapacitant medium, thereby maximizing the medium's laminar flow and minimizing the occurrence of vortices and turbulence. The laminar pipe also decreases the tubing's cross sectional area, and thereby increases the medium velocity according to Bernoulli's principle. This also counteracts some of the velocity loss that occurs as the medium exits the canister and enters the tubing. Once the medium reaches the end of the tubing, the nozzle 170 maximizes the throw distance of the medium and shapes the spray pattern into a fine stream. The nozzle is configured to provide a spray pattern that primarily extends forward on an axis parallel to the firearm barrel, and that maintains adequate clearance between the spray pattern and the underside of the firearm. This configuration provides a true aim capability for the operator and prevents incapacitant from fouling the firearm or its accessories. Some embodiments may include a mounting area 180 beneath the nozzle for housing a flashlight or targeting laser.

With further reference to FIG. 1, the disclosed invention includes a cavity in the handgrip portion of the device capable of holding a cylindrical canister 130 and magazine 190. The invention also may include a canister thumb ejector mechanism 195, a heel lock mechanism (not shown), or a bayonet mount (not shown). The magazine is configured with an opening into which the canister may be inserted and secured in the magazine so that an operator may quickly insert or remove the magazine and canister into the weapon as necessary in tactical situations. During magazine insertion, the magazine is placed in the cavity and the magazine is inserted until it locks in place. When locked, the magazine supplies upward force upon the canister sufficient to ensure that the canister is properly seated in the handgrip and that the canister tubing is properly seated in the actuator. The magazine also guides the canister into place, ensuring proper alignment of the canister tubing and actuator. During magazine ejection, the magazine holds the canister with sufficient force to overcome the force connecting the canister tubing with the actuator, so that the canister may be removed from the weapon.

Figure 2:
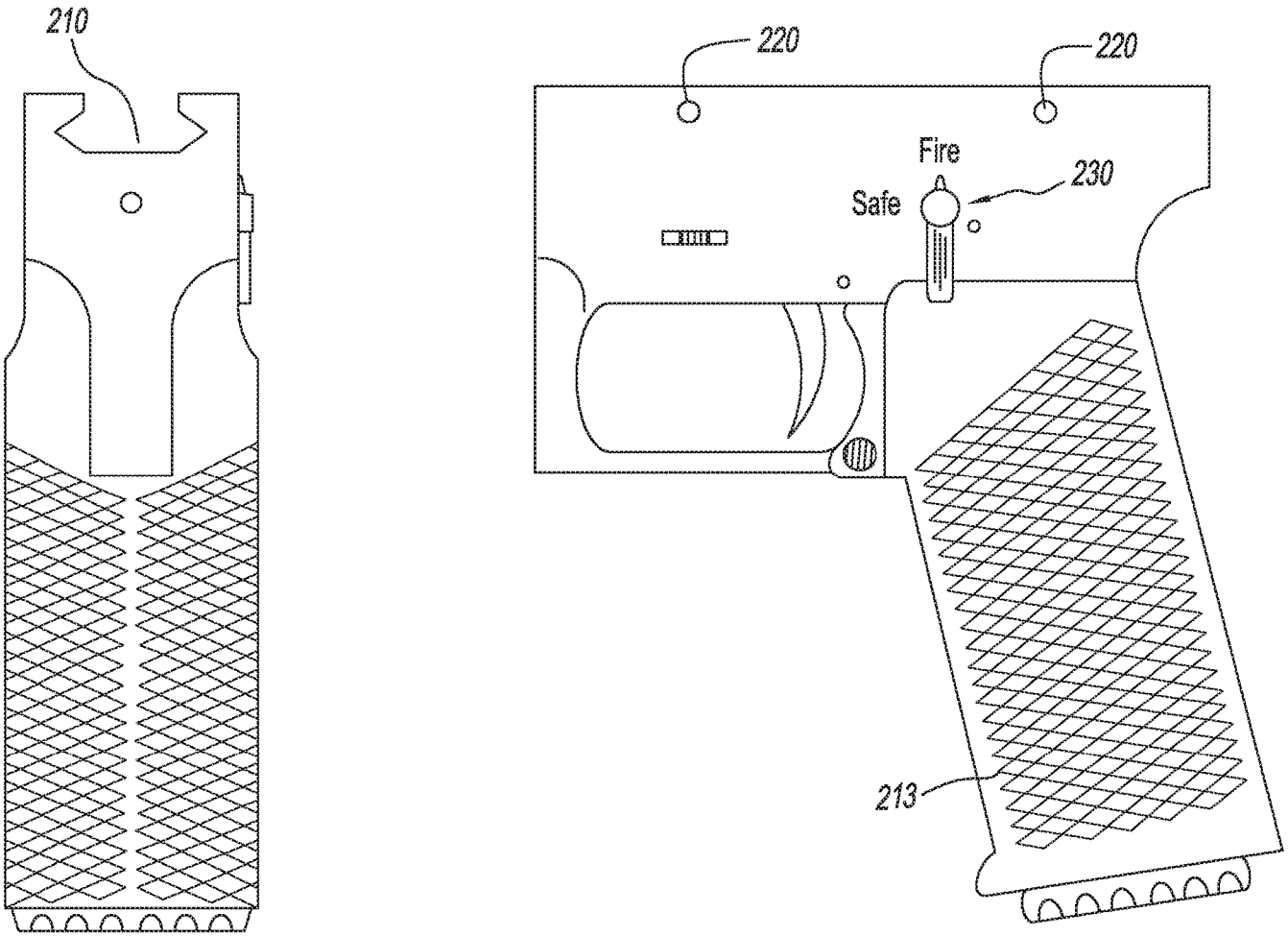
FIG. 2 is an example embodiment of at least a portion of a device of the disclosed invention including external front profile and side profile views.

With reference to FIG. 2, the device attaches to a firearm's picatinny rail system (MIL-STD-1913) via a channel 210 located at the top of the device. The device channel slides onto the rail, and when positioned for proper operation, the device is secured in place with a plurality of fasteners 220. The plurality of fasteners must adequately secure the device to the firearm, since the device acts as the forward grip of the firearm, and may need to bear the weight of the entire weapon system.

With further reference to FIG. 2, the disclosed invention may include a safety selector mechanism 230. The safety mechanism is designed to provide clear visual and tactile indication of the state of the device with respect to its safe operation. The safety selector can be turned between two positions: 1) FIRE, which allows the weapon to be discharged, and 2) SAFE, which prevents the weapon from discharging. The safety selector is mounted near the top rear of the weapon for convenient operation by a thumb or finger, and internally is positioned in proximity to the actuator mechanism, forward of the actuator pivot point. The selector may also include a switch mounted on each side of the weapon (not shown) for ease of use with either hand. Since the device acts as a forward grip, it will be operated by the non-dominant hand of the operator, while the dominant hand will operate the primary weapon function of the firearm. Having a safety switch on each side makes the device operable by either hand as necessary. In other embodiments, the safety selector mechanism may have only a single switch that can be alternatively placed on either side of the weapon. When the selector switch is aligned to the horizontal axis of the frame, the safety is engaged, and when the selector is aligned with the vertical axis, the safety is disengaged. Switch operation thus occurs over a 90-degree range of motion, which is the industry standard for a thumb safety. The safety selector mechanism is designed to accommodate any selector switch used with the common AR-15 weapons platform, so that an operator can interchange the selector switch for a preferred aftermarket switch if desired. The device's detent and spring also work with any standard safety switch. In some embodiments, the device may be used with a proprietary safety configuration that operates in the same manner as the standard safety switch.

Figure 3:
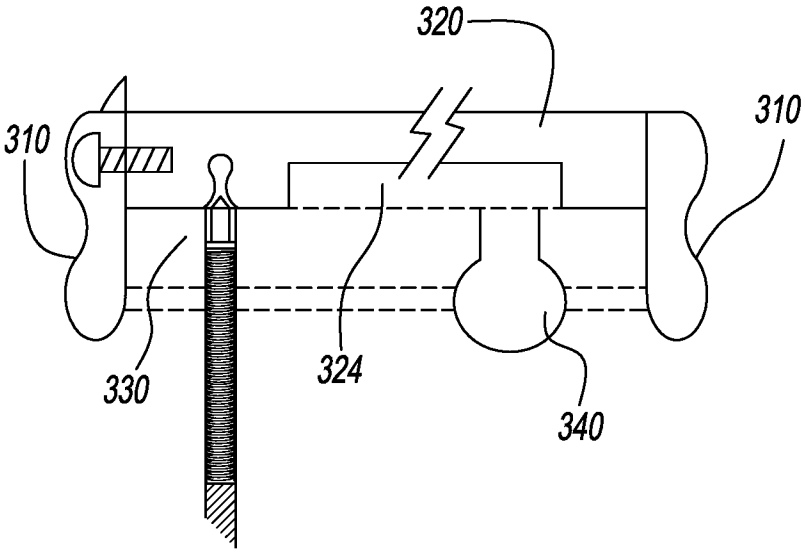
FIG. 3 is an example embodiment of at least a portion of the disclosed invention including a front profile view of a safety mechanism.

With reference to FIG. 3, the safety switch(es) 310 are connected to a selector rod 320 mounted laterally inside the frame. The selector rod includes a cut out 324 along a portion of the length of the rod. When the safety selector is in the FIRE position, the cut out provides clearance over the actuator mechanism 340, allowing the actuator to move upward when the trigger is pulled, and allowing the device to dispense the incapacitant. When moved to the SAFE position, the full radius of the selector rod is positioned over the actuator, blocking the upward movement of the actuator and, by extension, the trigger. Since the upward movement of the actuator, forward of the pivot, is required to discharge the device, having the selector in the SAFE position prevents the device from discharging.

Figure 4:
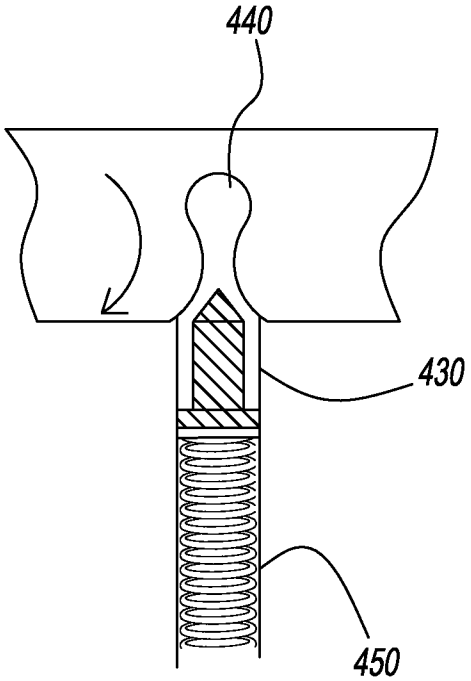
FIG. 4 is an example embodiment of at least a portion of a device of the disclosed invention including a depiction of a groove and detent feature of a safety mechanism.

The cut out is configured to operate in conjunction with a detent mechanism 330, which is positioned below the selector rod 320. With reference to FIG. 4, a channel 440 is cut along a portion of the circumference of the selector rod, and is aligned with the detent 430. The detent is kept in tension with the rod by a spring 450, which applies force to the detent. Together, the channel and detent mechanism define the limits that the selector switch may travel, since the detent has no path beyond the end of the channel. This ensures that the selector may only move between SAFE and FIRE positions. The channel also includes depressions in either end that correlate with the two positions of SAFE and FIRE. The depressions may be, for example, approximately 50% deeper than the channel. When the selector is in either of these positions, the detent seats itself into the depression and provides additional resistance to the selector. This additional resistance keeps the selector in the desired position until moved by the operator. In order to move the selector between positions, the operator must supply additional force to depress the detent sufficiently so that it can return to the shallow portion of the channel and then move freely forward or backward. Moving the switch into the FIRE or SAFE position also provides an audible click as the detent seats into the depression.

Figure 5:
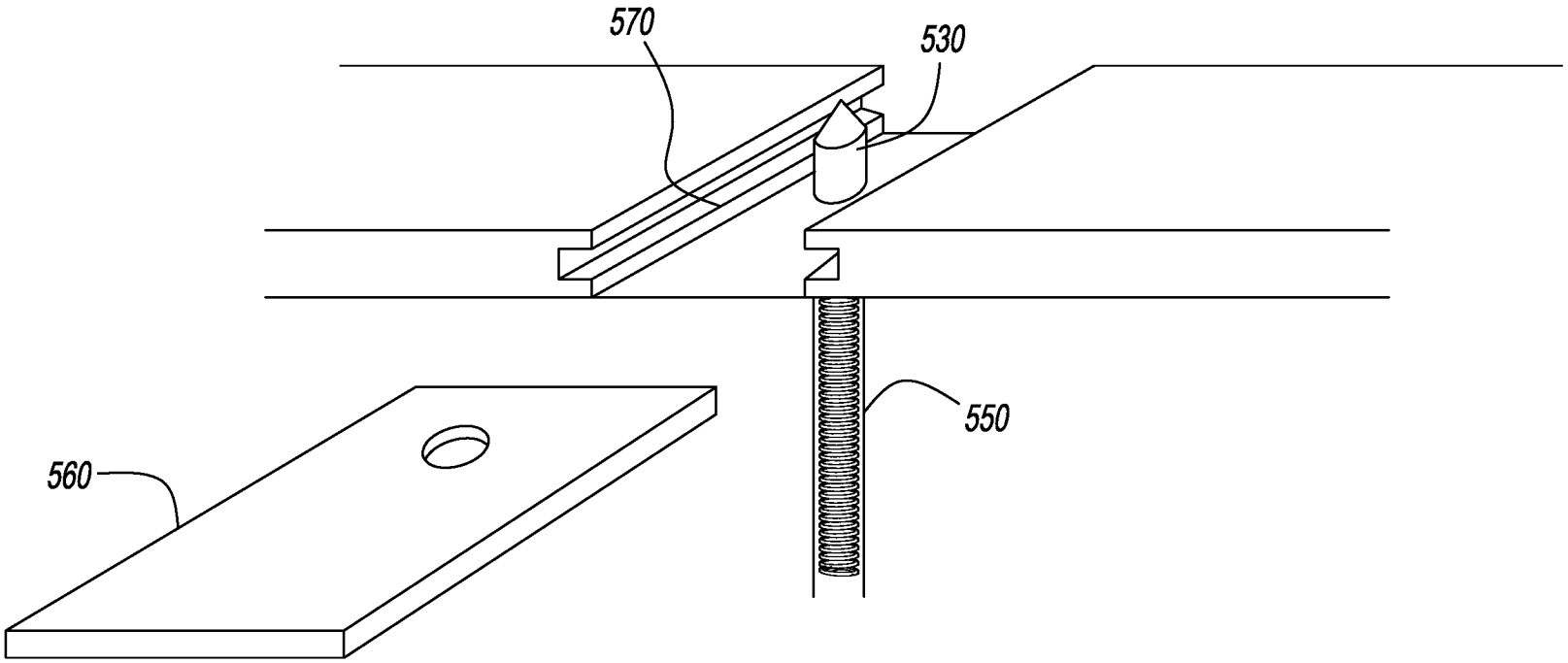
FIG. 5 is an example embodiment of at least a portion of a device of the disclosed invention including a depiction of a safety mechanism detent and detent plate.

With reference to FIG. 5, the detent 530 and detent spring 550 may be retained by a detent plate 560, which is inserted into a channel 570 to hold it in place.

Figure 7:
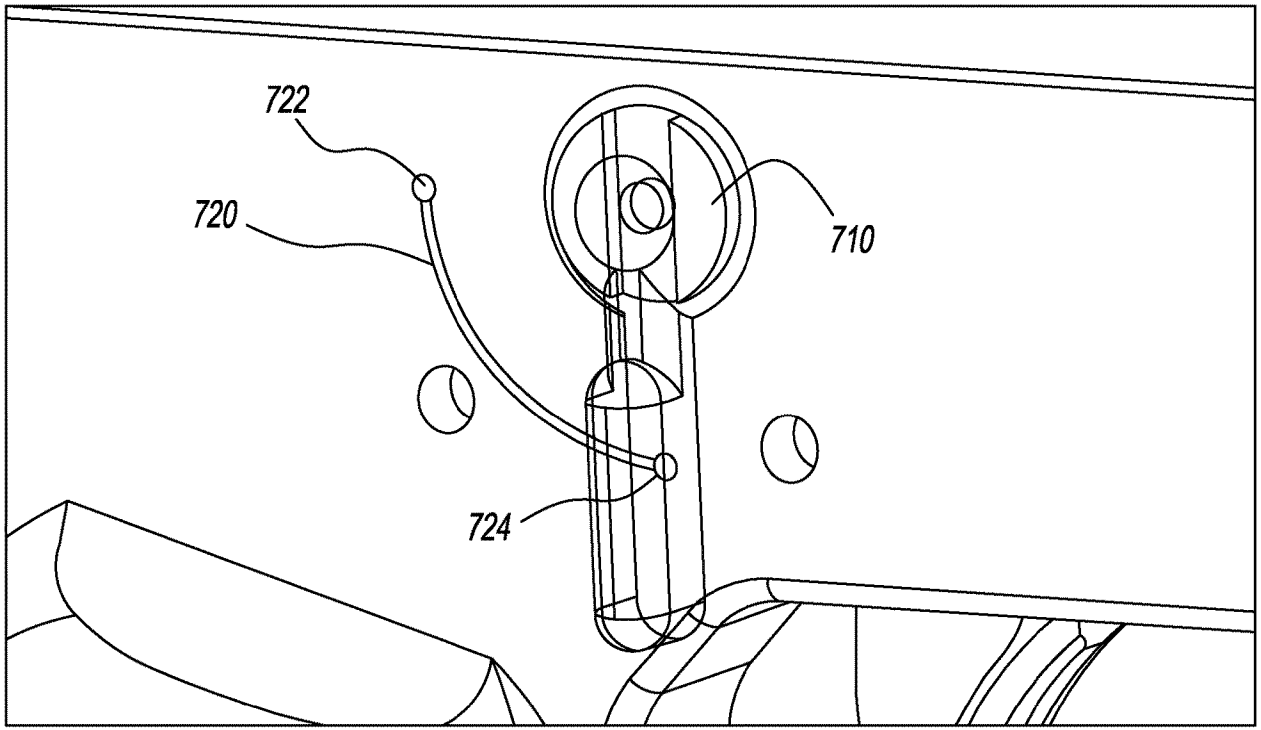
FIG. 7 is an example embodiment of at least a portion of a device of the disclosed invention including a depiction of a safety selector mechanism with an alternate external configuration.

With reference to FIG. 6, in an alternate embodiment, the safety selector mechanism may have a different internal configuration while providing equivalent operation and similar external appearance. The safety selector switch is connected to a selector rod 620 mounted laterally inside the weapon frame. The selector rod includes a channel along a portion of the circumference of the rod, so that when the switch is in a first position, correlated with the FIRE position, the cut out portion of the selector rod allows the upward movement of the trigger and actuator, and when the switch is in a second position, correlated with the SAFE position, the cut out portion prevents upward movement of the trigger and actuator. With reference to FIG. 7, the path of travel for the switch 710 is determined by a semi-circular channel 720 in the exterior handgrip frame and a corresponding detent in the switch that requires the switch to travel a prescribed curve. At a first end of the channel is a depression 722 into which the detent seats that terminates the path of travel and correlates with the FIRE position. At a second end of the channel is a depression 724 into which the detent seats that terminates the path of travel and correlates with the SAFE position. Together the channel and the detent define the limits the selector switch may travel. When the selector is in either the SAFE or FIRE positions, and the detent is seated in a depression, the detent provides additional resistance to the selector that serves to keep the selector in the desired position until moved by the operator. Tension on the detents is provided by the elasticity of the material used to fabricate the mechanism.

Figure 9:
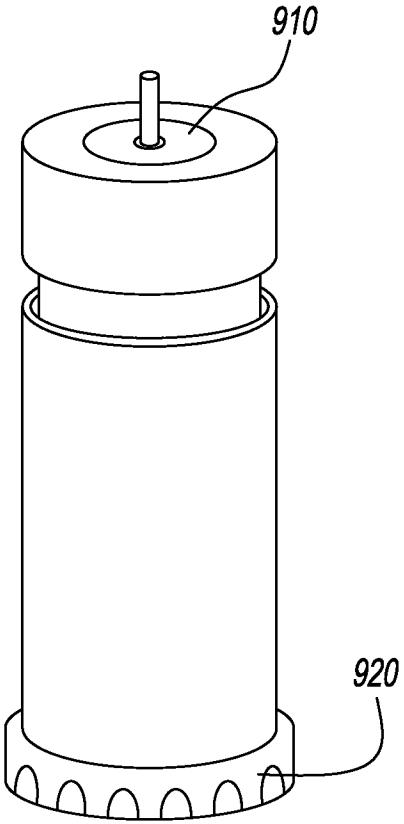
FIG. 9 is an example embodiment of at least a portion of a device of the disclosed invention including a depiction of a full sleeve canister magazine with trench-type mount.
Figure 8:
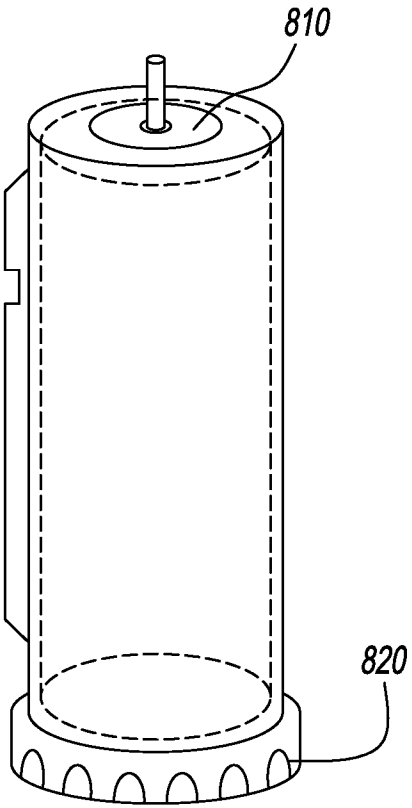
FIG. 8 is an example embodiment of at least a portion of a device of the disclosed invention including a depiction of a full sleeve canister magazine with rail-type mount.

With reference to FIGS. 8 and 9, the disclosed invention may be used with a full sleeve magazine. The full sleeve magazine completely covers the canister from the base to the shoulder, leaving an opening in the top 810, 910 sufficiently large to fully expose the canister tubing, but not large enough to allow the canister to pass through the magazine during ejection. The canister may be inserted into and removed from the magazine by means of a floor plate in the bottom of the magazine 820, 920 opposite the top opening. The floor plate may be secured to the body of the magazine via any of several mechanisms, which may include a pivoting arm, screws, a hinge and a latch, or a screw cap mechanism.

Figure 10:
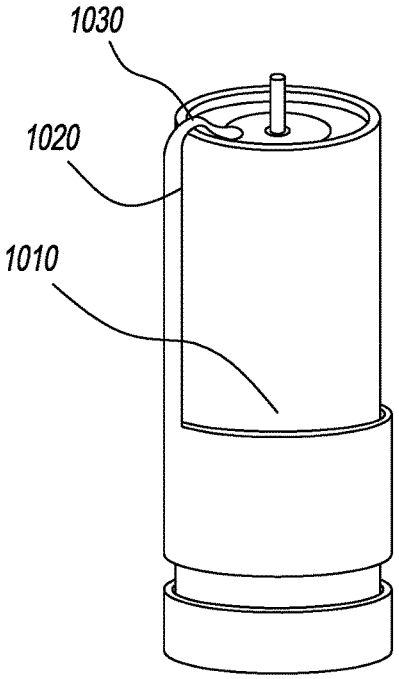
FIG. 10 is an example embodiment of at least a portion of a device of the disclosed invention including a depiction of a partial-sleeve magazine with clip-type mount.
Figure 11:
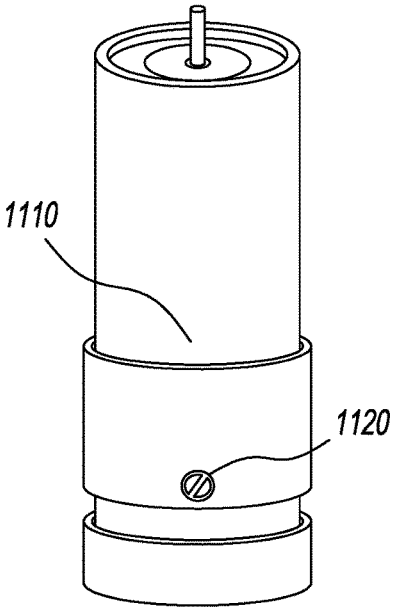
FIG. 11 is an example embodiment of at least a portion of a device of the disclosed invention including a depiction of a partial-sleeve magazine with set screw-type mount.
Figure 12:
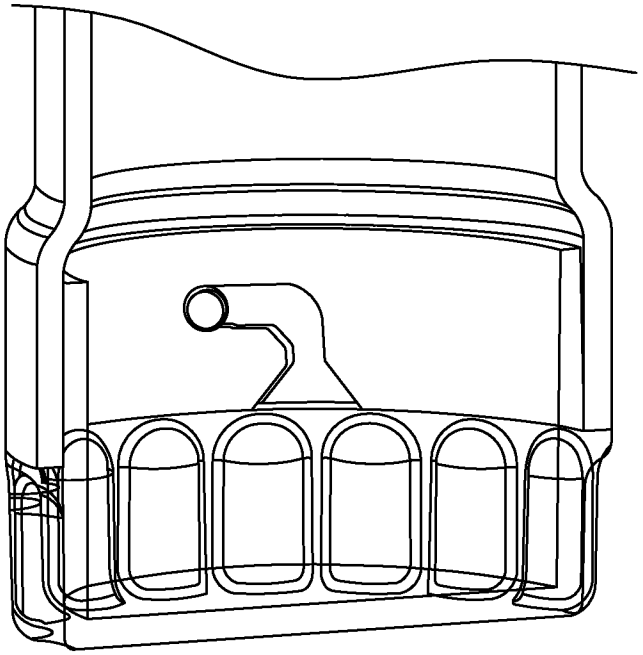
FIG. 12 is an example embodiment of at least a portion of a device of the disclosed invention including a depiction of a partial-sleeve magazine with bayonet mount.

With reference to FIGS. 10, 11 and 12, an embodiment of the disclosed invention is shown with a partial sleeve magazine. The partial sleeve magazine allows the canister to be inserted into an opening in the top of the magazine 1010, 1110 and secured therein with a clip 1020, tension screw 1120, a bonding agent, such as an epoxy, or other similar means. FIG. 10 shows the partial sleeve magazine with a clip to secure the canister. The clip extends the length of the canister and hooks over the canister's shoulder 1030. The clip will secure the canister by applying sufficient downward force on the canister shoulder during extraction to overcome the force connecting the canister tubing with the actuator. Such a clip may be manufactured of metal, plastic or other material, as long as the material is flexible enough to allow the canister to pass into the sleeve before latching it securely into place. FIG. 11 shows a partial sleeve magazine with a tension screw. The canister is inserted into the partial sleeve and the tension screw is tightened against the canister wall, which secures the canister with sufficient force during extraction to overcome the force connecting the canister tubing with the actuator. FIG. 12 shows a partial sleeve magazine with a bayonet mount mechanism. The canister is secured to the magazine by a bonding agent, such as an epoxy or other adhesive.

Whether configured with a full sleeve or partial sleeve magazine, the magazine must be securely locked within the device in order to guarantee proper operation and safety. Likewise, once locked within the device, the magazine requires a method to allow for safe removal. Locking and ejection of the magazine may be accomplished by a thumb lock and ejector, by a heel lock, or by a bayonet mount mechanism.

Figure 13:
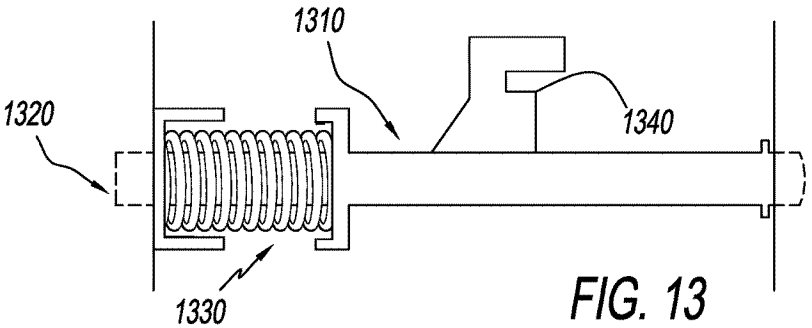
FIG. 13 is an example embodiment of at least a portion of a device of the disclosed invention including a depiction of a top profile view of an ejector assembly.
Figure 15:
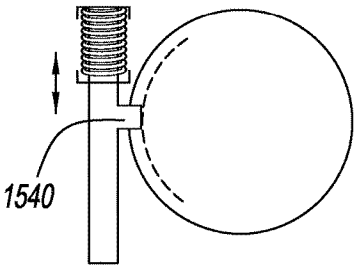
FIG. 15 is an example embodiment of at least a portion of a device of the disclosed invention including a depiction of an ejector assembly for the trench-type full sleeve magazine.
Figure 14:
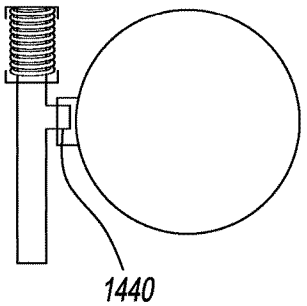
FIG. 14 is an example embodiment of at least a portion of a device of the disclosed invention including a depiction of an ejector assembly for the rail-type full sleeve magazine.

In certain embodiments, magazines may be used with a thumb ejector. With reference to FIG. 13, the thumb ejector assembly 1310 includes at least one button 1320 that is held under tension by a spring 1330. The assembly passes laterally across the handgrip behind the trigger, and has a latch bolt 1340 that protrudes into the magazine cavity. As the magazine is inserted, the latch bolt is forced out of the cavity by the magazine walls or the magazine rail, which overcome the resistance of the assembly spring 1330. When the magazine is fully inserted, a trench or a rail notch aligns with the depressed latch bolt, and the ejector assembly spring forces the bolt to seat into the trench or notch. FIG. 8 shows an embodiment of the full sleeve magazine with a rail-type securing mechanism. In this embodiment, the latch bolt 1440 engages a notch in the rail, as shown in FIG. 14. FIG. 9 shows an embodiment of the full sleeve magazine with a trench-type securing mechanism. In this embodiment, the latch bolt 1540 engages with a trench, as shown in FIG. 15. In either embodiment, when the magazine is in place, and the ejector button is depressed, the latch bolt disengages from the magazine securing mechanism and allows the magazine to be removed from the magazine cavity.

Figure 16:
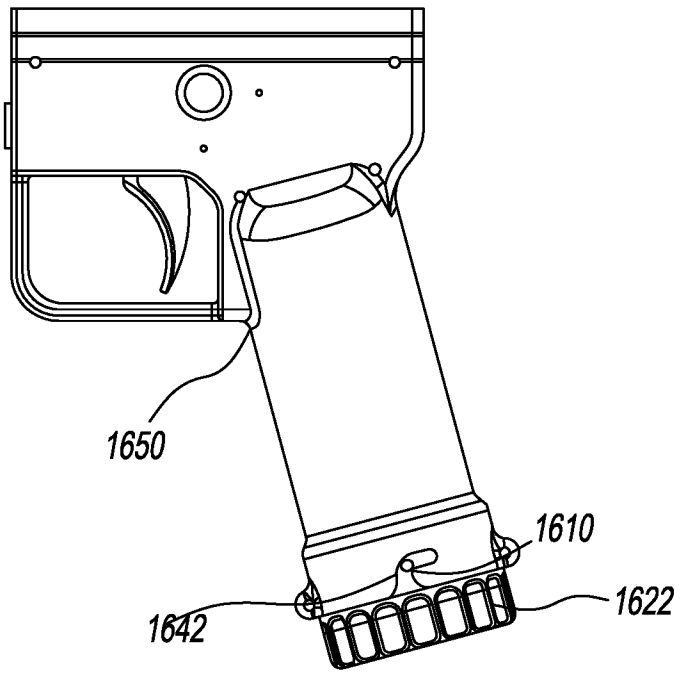
FIG. 16 is an example embodiment of at least a portion of a device of the disclosed invention including a depiction of a partial-sleeve magazine with a bayonet mount.
Figure 16:
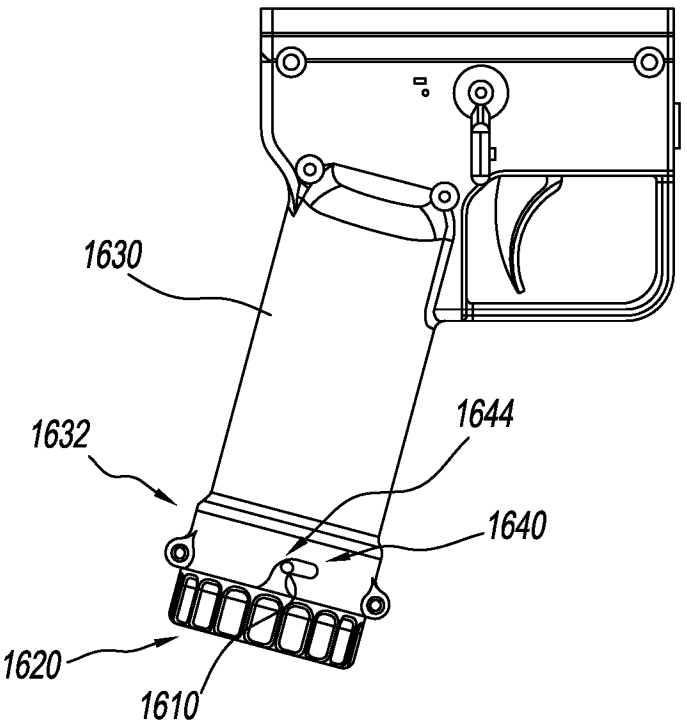

With reference to FIG. 16, in some embodiments, the magazine may be secured in the device by means of a bayonet mount mechanism. In such a configuration, the magazine has at least two bayonet lugs 1610 spaced at equal intervals around the circumference of the magazine, for example, two bayonet lugs may be placed opposite one another at the base of the magazine 1620. The handgrip 1630 includes a section 1632 at the bottom end configured to accommodate a portion of the magazine, and including a plurality of complimentary channels 1640 configured to mechanically interact with the bayonet lugs. The channels have a first section 1642 that is oriented perpendicularly to the base of the handgrip. The first section has an open end at the base of the handgrip, and an elbow end that is configured to smoothly transition to a second section of the channel. The first section is wider at the open end to facilitate rapid alignment with the magazine. The second section 1644 of the channel is oriented 90 degrees from the first section. When viewed from the top of the weapon, the second section extends in a counter-clockwise direction around the circumference of the handgrip, and terminates in a small semicircular recess (recess not shown). During magazine insertion, the device operator aligns bayonet lugs with the channels. Once the lugs are aligned and placed inside the first section, the magazine is moved upward until the lugs have reached the elbow end of the channel and then the magazine is twisted counter-clockwise to lock the magazine in place. During the twisting motion, the lugs move along the second section of the channels and drop into place into the recesses. The recesses provide secure and accurate positioning of the magazine during operation. The magazine is at least partially held in place by tension created between the lugs and the recesses when the magazine is locked in position. To remove the magazine, the operator pushes the magazine up to lift the lugs out of the recesses and then twists the magazine in a clockwise direction (when viewed from the top of the weapon), causing the lugs to retrace their paths along the channels, and then the operator pulls the magazine downward out of the handgrip. At this point, the magazine can be discarded and a new magazine inserted.

With further reference to FIG. 16, the magazine has an exterior section 1622 that remains outside the handgrip cavity when the magazine is inserted and locked in place. The exterior section aligns with the circumference of the handgrip so that the exterior section serves as additional handgrip length. When locked in place, a standard length magazine and handgrip will provide an effective handgrip length that is not less than three inches from the bottom of the trigger well 1650 to the end of the magazine. In some embodiments, the magazine may be of different lengths to allow customization of the effective handgrip length to accommodate operator requirements.

Figure 17:
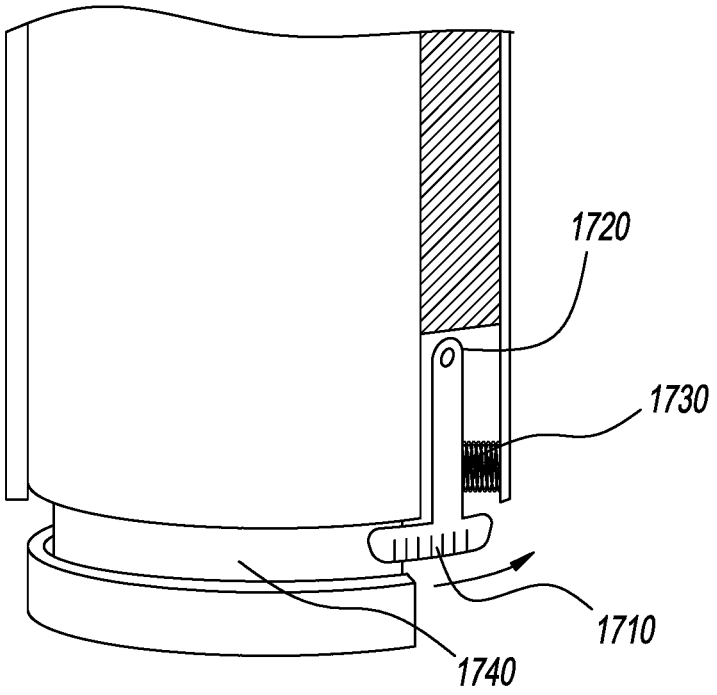
FIG. 17 is an example embodiment of at least a portion of a device of the disclosed invention including a depiction of a heel lock mechanism for securing a magazine.
Figure 18:
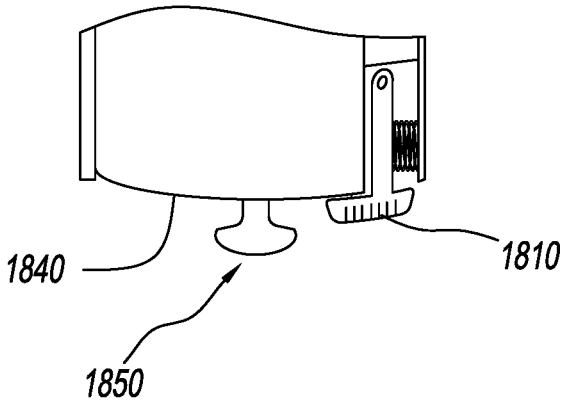
FIG. 18 is an example embodiment of at least a portion of a device of the disclosed invention including a depiction of a heel lock mechanism for securing a magazine, with pommel.

With reference to FIGS. 17 and 18, some embodiments may be used with a heel lock 1710. The heel lock is a latch mechanism that secures the magazine into the magazine cavity from below. The latch has a pivot pin 1720 and is held against the magazine by a spring 1730. To insert the magazine, the heel lock is pulled aside to allow unhindered access to the magazine cavity. Once the magazine is partially inserted, the force of the magazine walls overcome the heel lock spring's resistance. When the magazine is fully inserted, the heel lock will seat itself either into a trench in the base of the magazine, or under the base of the magazine. FIG. 17 shows a magazine with a trench 1740 near the base into which the heel lock seats. FIG. 18 shows a magazine held in place by the heel lock 1810 seated under the magazine base 1840. This embodiment will be used with a pommel 1850 to allow easy extraction of the magazine. In order to remove the magazine, the operator moves the heel lock out of the trench or away from the base and applies downward force to the magazine. For the trench-type magazine, the trench and area below the trench will aid in the removal of the magazine. If the magazine does not have a trench, some form of pommel must be included to aid magazine removal.

Either style of partial sleeve magazine may alternatively be configured for use with a thumb ejector by substituting a rail or trench as used on the full sleeve magazine (not shown) for the trench or pommel configurations described above.

Either style of full sleeve magazine may alternatively be configured for use with a bayonet mount mechanism by substituting a bayonet-lug attachment as used on the partial sleeve magazine (not shown) for the rail or trench configurations described above.

Figure 19:
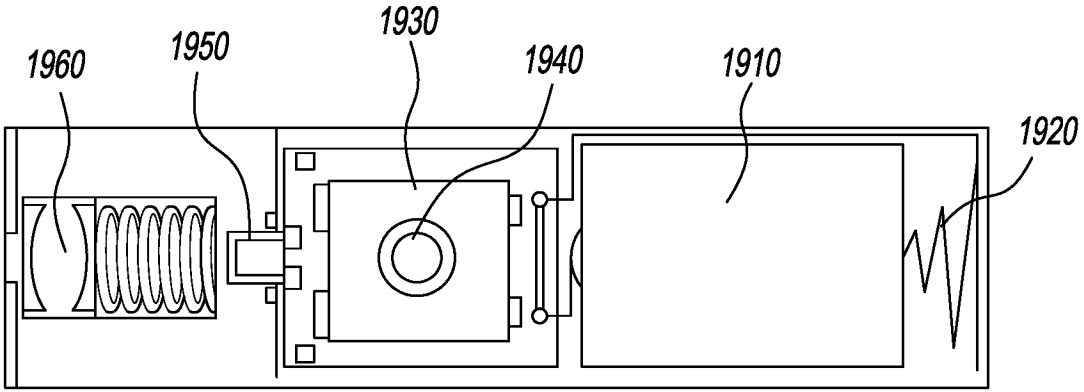
FIG. 19 is an example embodiment of at least a portion of a device of the disclosed invention including a laser device insert.

With reference to FIG. 19, in some embodiments, the disclosed invention may include a targeting laser integrated into a mounting chamber at the front of the device just below the nozzle. The laser is configured according to techniques known in the art. For example, it may be powered by one or more batteries 1910 inserted into the back of the chamber where they rest against a battery spring 1920. The battery spring serves as an electrical contact and is electrically connected to the laser diode driver 1930. Forward of the battery(ies) is the second electrical contact which completes the circuit with the laser diode driver, which is forward of the second contact. The laser diode driver powers the diode and includes a power switch 1940. The laser diode driver is connected to the laser diode module 1950, which contains a collimating lens 1960 to focus the laser. The laser module is flush with the forward end of the device. A power switch may be exposed on one, or both sides of the device to allow ambidextrous operation. This power switch transmits the operator's force when depressed to the internal switch on the laser diode driver.

Figure 20:
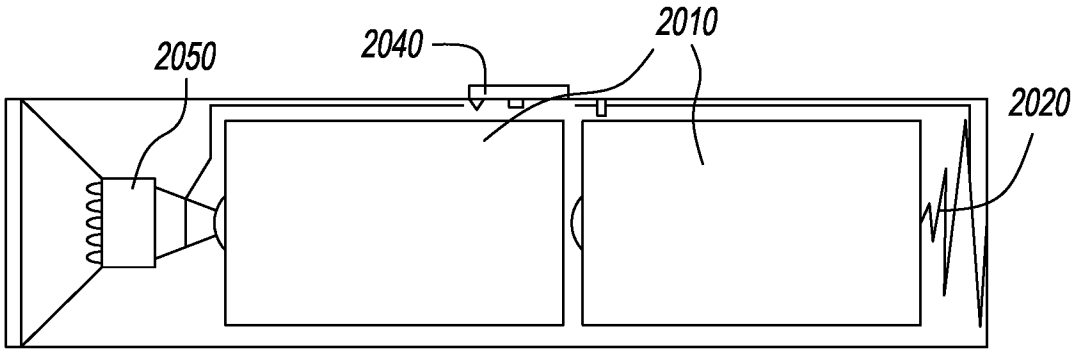
FIG. 20 is an example embodiment of at least a portion of a device of the disclosed invention including a flashlight device insert.

With reference to FIG. 20, the disclosed invention alternatively may include a flashlight integrated into the mounting chamber. The flashlight is configured according to techniques known in the art. For example, it may be powered by one or more batteries 2010 inserted into the back of the chamber where they rest against a battery spring 2020. The battery spring serves as an electrical contact and is electrically connected to a power slide switch 2040. Forward of the battery(ies) is the second electrical contact which completes the circuit with the LED array 2050, which is forward of the second contact. The LED array may include a plurality of individual LED bulbs. A window is mounted flush with the forward end of the device and may be manufactured out of sapphire or other suitably durable material, and is held in place by a screw cap. The power slide switch can be moved to a forward position to complete the circuit or to a backward position which will interrupt it.

This has been a description of the disclosed invention along with a preferred method of practicing the disclosed device, however the invention itself should only be defined by the appended claims.

What is claimed is:

1. A device for dispensing less-lethal incapacitants, comprising:

a foregrip capable of attachment to a firearm;

a trigger mechanism positioned on the foregrip;

an actuator that causes an incapacitant medium to be released from a canister, where the actuator is comprised of a first component that is in contact with the trigger mechanism, a pivot point about which the first component can move when the trigger mechanism is pulled, an opening to allow a flexible tube to pass through the first component with a clearance to enable the actuator to move without interfering with the flexible tube, and a second component configured to interact with the first component, said second component further having a cup configured to secure to a canister outlet tube and to provide a connection point for the flexible tube;

wherein the flexible tube connects the actuator to a nozzle; wherein the flexible tube is comprised of a first end that connects to the actuator, and a second end that connects to the nozzle; the flexible tube being routed through the foregrip to minimize a length of the flexible tube and having an inner diameter that is larger than the canister outlet tube; the second end of the flexible tube further having a section of laminar pipe secured inside the flexible tube, the pipe extending from the nozzle toward the first end of the flexible tube; and wherein the nozzle is configured to shape a spray pattern of the incapacitant medium, wherein the spray pattern is aligned with a longitudinal axis of the firearm, and the spray pattern avoids contact with the firearm;

a safety mechanism positioned on the foregrip;

a magazine configured to hold the canister, and wherein the magazine is secured to the canister by an adhesive; and a magazine cavity configured to accept the magazine, wherein the magazine interacts with the magazine cavity to allow the canister outlet tube to seat in the cup.

2. The device of claim 1, wherein the foregrip has a plurality of fasteners, and wherein the foregrip further has a channel that attaches to a picatinny rail system on the firearm.

3. The device of claim 1, wherein the foregrip has a handgrip with a plurality of finger grips.

4. The device of claim 1, wherein the foregrip has a handgrip with a plurality of grooves to improve grip.

5. The device of claim 1, wherein the trigger mechanism is comprised on a trigger having a first portion extending out from the foregrip and shaped as a finger grip; a second portion oriented approximately perpendicular to the first portion and located at least partially inside the foregrip, the second portion having a pivot point secured to the foregrip about which the trigger can move when the finger grip is actuated, the pivot point being located behind a front face of the finger grip, and the trigger mechanism further having an area in contact with the actuator and a spring supplying a trigger pull weight force to the trigger.

6. The device of claim 1, wherein the foregrip is configured with a trigger guard.

7. The device of claim 1, wherein the safety mechanism is comprised of a safety selector rod placed in proximity to the actuator forward of the actuator's pivot point and where the safety selector has a cut out section; at least one safety switch having a range of motion between a first position which corresponds to an orientation of the safety selector rod which allows the actuator to move, and a second position which corresponds to an orientation of the safety selector rod which does not allow the actuator to move; the at least one safety switch further having a detent mechanism configured to interact with a channel in an exterior frame of the foregrip so that the at least one safety switch follows a curved path prescribed by the channel; the channel in the exterior frame of the foregrip having a semi-circular shape with a first end and a second end, the first end having a first depression configured to fit the detent mechanism of the at least one safety switch and corresponding to the second position of the at least one safety switch, and the second end having a second depression configured to fit the detent mechanism of the at least one safety switch and corresponding to the first position of the at least one safety switch; where the detent mechanism of the at least one safety switch resists movement of the at least one safety switch when the detent mechanism of the at least one safety switch is seated in the first depression or the second depression.

8. The device of claim 7, wherein the at least one safety switch can be removed and replaced by a switch of a different design.

9. The device of claim 1, wherein the magazine is a partial sleeve magazine that covers a base of the canister and at least a portion of a side of the canister, comprised of a base section connected to a cylindrical sleeve that covers the portion of the side of the canister.

10. The device of claim 9, wherein the magazine has a bayonet-type latching mechanism comprising a plurality of bayonet lugs configured to engage with a plurality of channels in a base of the foregrip, and where the plurality of bayonet lugs and the plurality of channels secure the magazine when the magazine is fully inserted into the magazine cavity and rotated around an axis perpendicular to the base section of the magazine.

11. The device of claim 1, wherein the foregrip has an accessory chamber at a front of the foregrip below the nozzle suitable for mounting accessories therein.

12. The device of claim 11, wherein the accessory chamber is fitted with a targeting laser.

13. The device of claim 11, wherein the accessory chamber is fitted with a flashlight.

* * * * *